United States Patent [19]

Itkis

[11] Patent Number: 4,856,787

[45] Date of Patent: Aug. 15, 1989

[54] CONCURRENT GAME NETWORK

[75] Inventor: Boris Itkis, Arcadia, Calif.

[73] Assignee: Yuri Itkis, Arcadia, Calif.

[21] Appl. No.: 198,599

[22] Filed: May 3, 1988

Related U.S. Application Data

[63] Continuation of Ser. No. 826,269, Feb. 5, 1986, abandoned.

[51] Int. Cl.[4] ..... A63F 3/06

[52] U.S. Cl. ..... 273/237; 273/269

[58] Field of Search ..... 273/1 E, 85 G, 138 A, 273/237, 143 R, 269, DIG. 28; 235/380, 382, 382.5; 364/410–412

[56] References Cited

U.S. PATENT DOCUMENTS

| | | | |
|---|---|---|---|
| 4,305,131 | 12/1981 | Best | 273/1 E |
| 4,455,025 | 6/1984 | Itkis | 273/237 |
| 4,467,424 | 8/1984 | Hedges et al. | 273/138 A |
| 4,624,462 | 11/1986 | Itkis | 273/269 |
| 4,634,845 | 1/1987 | Hale et al. | 235/380 |

*Primary Examiner*—William H. Grieb

*Attorney, Agent, or Firm*—Roylance, Abrams, Berdo & Goodman

[57] ABSTRACT

A distributed game network comprising a master game device and a number of slave game devices. The slave game device is capable of playing concurrently a number of menu selectable card and chance games, such as poker, bingo, blackjack, and keno. The slave game device receives commands and random data, such as bingo patterns and called bingo and keno numbers, from the master game device and sends the local game status and accounting information to the master game device. The slave game device is equipped with a touch screen display and a smart game card interface. The smart game card associated with the slave game device has an imbedded microprocessor keeping track of wagers and outcomes of the game. The touch screen display exhibits the status of the games being played in display windows and accepts player's commands including menu selections and bingo and keno card marks.

7 Claims, 7 Drawing Sheets

CONCURRENT GAME NETWORK

This is a continuation of application Ser. No. 826,269, filed Feb. 5, 1986, now abandoned, the entire disclosure of which is hereby incorporated by reference.

BACKGROUND OF THE INVENTION

This invention relates generally to games and game devices and, in particular, to games, such as bingo, keno, poker, and blackjack, and game devices for casinos and game parlors.

The U.S. Pat. No. 4,455,025 disclosed the concept of a game network for playing prepayed card games, such as bingo, keno, and the like. Although the disclosed game network provides a player with a convenient and simple way to play concurrently multiple bingo or keno cards, the U.S. Pat. No. 4,455,025 does not deliniate techniques of real time selection of a specific game to be played. On the other hand, the U.S. Pat. No. 4,467,424 provides the player with a means to select a game, such as keno, to be played on the player's remote terminal while not allowing for playing a large number of game cards with the help of a single players terminal.

Neither of the above patents allows for concurrent playing of multiple different games, e.g. simultaneous playing of poker, bingo, and keno, with just one player's terminal; let alone provisions for concurrent playing of multiple games with multiple sets of game cards in each of the multiple games being played. Similarly, neither of the identified U.S. patents discloses gaming devices for playing other popular casino games, such as poker, blackjack, and sports races, nor teaches the concept of a concurrent playing of these games in combination with other traditional casino games.

These disadvantages restrict a player's freedom of choice and limit the services providable by casinos and game parlors.

SUMMARY OF THE INVENTION

The present invention is a distributed game network comprising a master game device and a number of slave game devices. The master and slave game devices communicate with each other over the network. The slave game devices receive from the master game device commands and random data, such as bingo patterns and bingo and keno numbers called by the game operator. Each slave game device sends to the master game device the local game status and accounting information. The slave game devices execute in real time (play) concurrently a number of menu-selectable card and chance games, such as bingo, keno, poker, blackjack, and the like.

The status of all the games being played with the help of a slave game device is presented on a touch screen display in individual windows dedicated to specific games. The display also shows the accounting data pertinenet to all the games, such as wagers, prizes, and balances. Being a touch screen device, the display facilitates the selection of the games, the modes of playing the selected games, and the values of bets. In addition, the touch screen provides an opportunity to manually mark bingo and keno matches on the screen. The slave game device is also equipped with a smart game card reader and writer. The smart game card associated with the slave game device is equipped with an imbedded microprocessor keeping track of bets and outcomes of the games. In addition, the smart game card stores in encoded form the information identifying the contents of the game card images presented on the display, e.g. bingo card contents.

The slave game devices may be combined in clusters participating in a common game, e.g. a cluster of slave game devices playing a common poker game with one master game device operated by a card dealer. Slave game devices may also pool together their resources including monetary resources and cooperate in achieving a common goal, e.g. the players operating the pooled slave game devices may split the game prize.

It is the primary objective of this invention to introduce a game network providing each player with an opportunity to select and play simultaneously a variety of different games while facilitating a concurrent playing of multiple game cards for the selected games.

It is an additional objective of this invention to provide a player with an opportunity to select a degree of difficalty of playing a game of his or her choice. It is another objective of this invention to provide a player with a convenient means of identifying the current status of the games being played with the help of the game device. It is also an objective of this invention to provide a coinless betting means in conjunction with the operation of the game network. These and other objectives will become more apparent upon further reading of the specification.

DESCRIPTION OF THE PREFERRED EMBODIMENT

Figure 1:
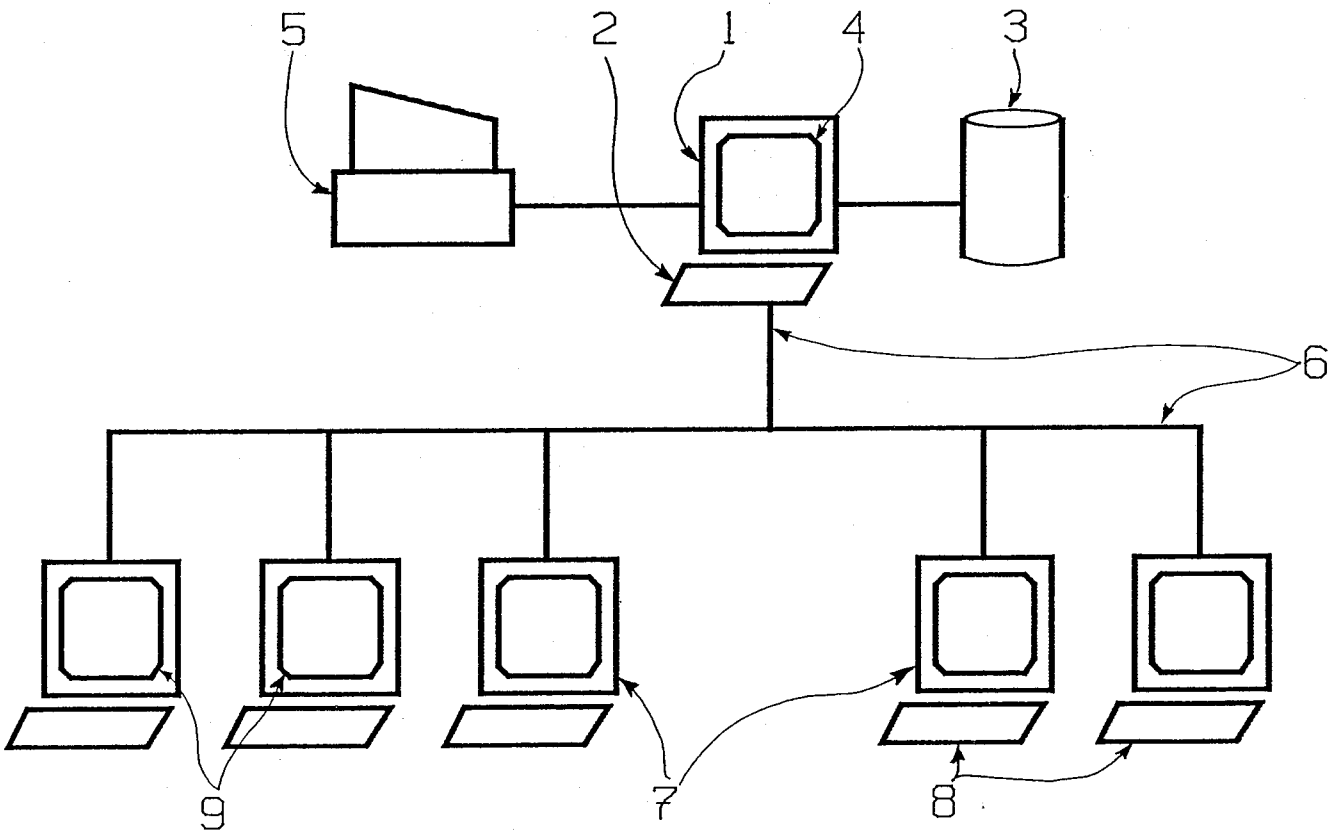
FIG. 1 shows the hardware architecture of the game network.

The preferred configuration of the game network exhibited in FIG. 1 incorporates the master game device 1 and a number of slave game devices 7. The master game device 1 is equiped with the full fledged keyboard 2, hard disk 3, the display 4, and the printer 5. The master game device is interconnected with the slave game devices 7 via a communication network 6. Each of the slave game devices 7 is equipped with the simplified keypad 8 and the displays 9.

Figure 2:
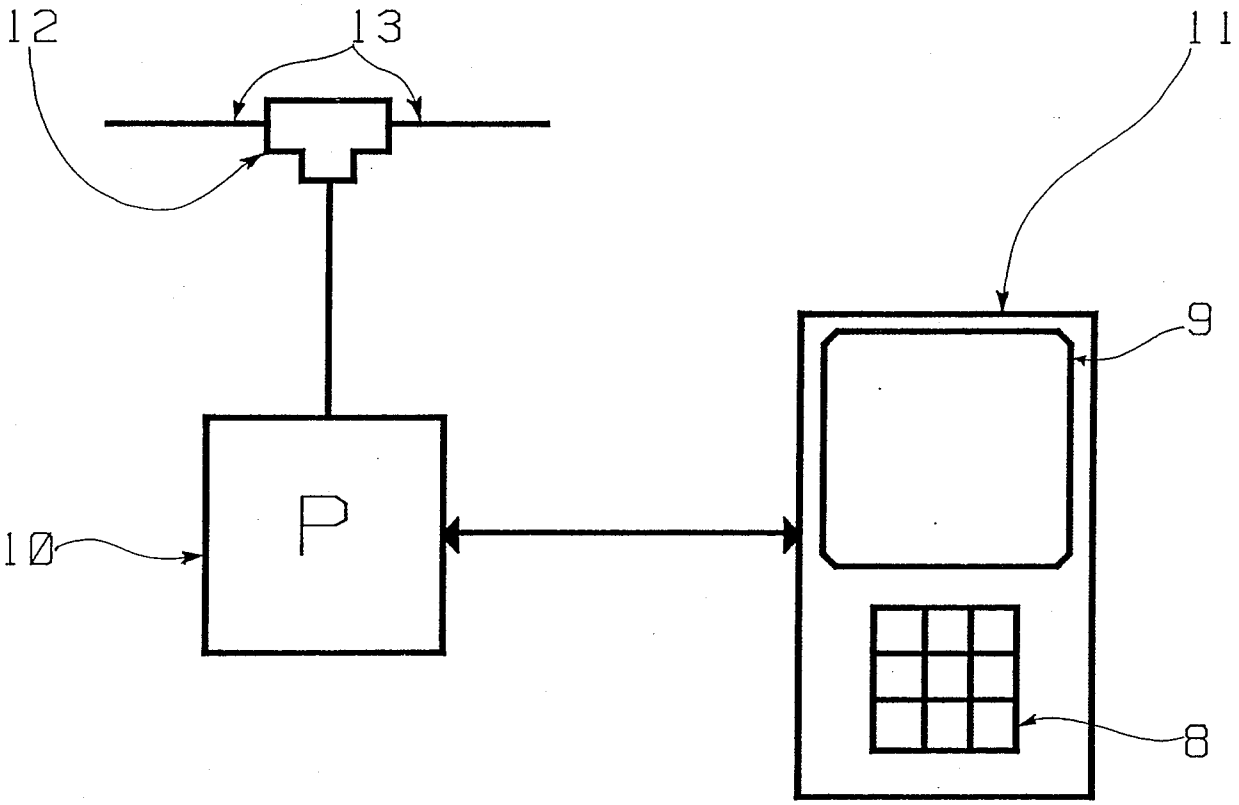
FIG. 2 shows the hardware architecture of a game device incorporated into the game network.

The slave game device presented in FIG. 2 is an intelligent (smart) game terminal comprising the microprocessor 10, the local data input and output means 11 including the keypad 8, and the transceiver 12; the latter providing the direct interface with the rest of the network 6 via the coaxial cable 13.

In the process of a game, the master game device 1 is used by a game operator, slave game device 7 is utilized by a player. The game operator controls the game network by entering predetermined commands and random data into the master game device 1 via the keyboard 2. Similarly, the player operates the slave gaming device 7 by entering his or her commands, such as an wager value, via the keypad 8.

The menus of available commands and options including help options are displayed to the game operator and the player upon reset or upon entering a respective command. An example of a master game device bingo game submenu is shown in FIG. 6, and an illustration of the slave game device main menu is provided in FIG. 5. Both, the master and the slave game devices 1 and 7 respectively communicate their responses to the game operator and to the player via respective data input and output means, in particular, displays 4 and 9.

Figure 3:
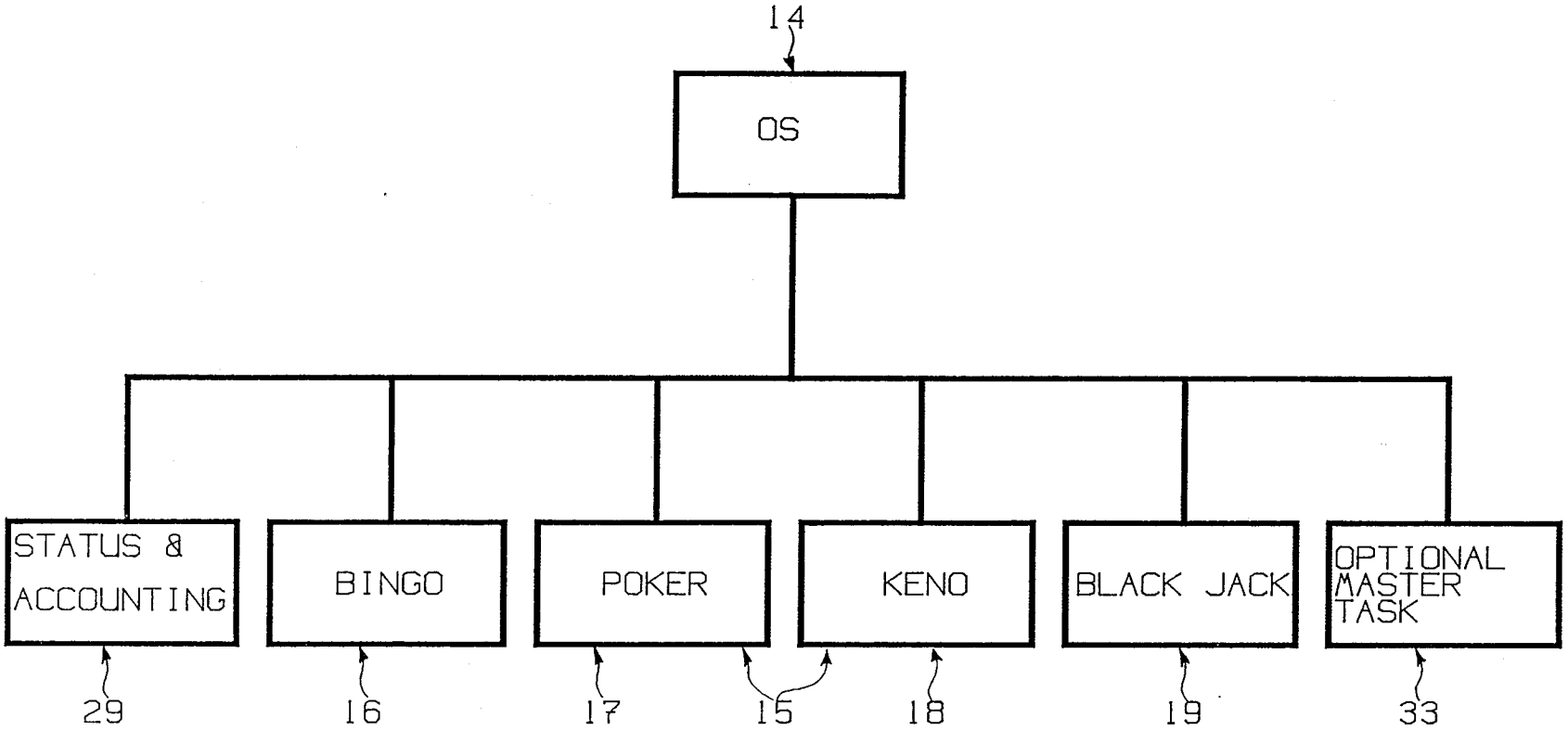
FIG. 3 shows the software architecture of the game device.
Figure 4:
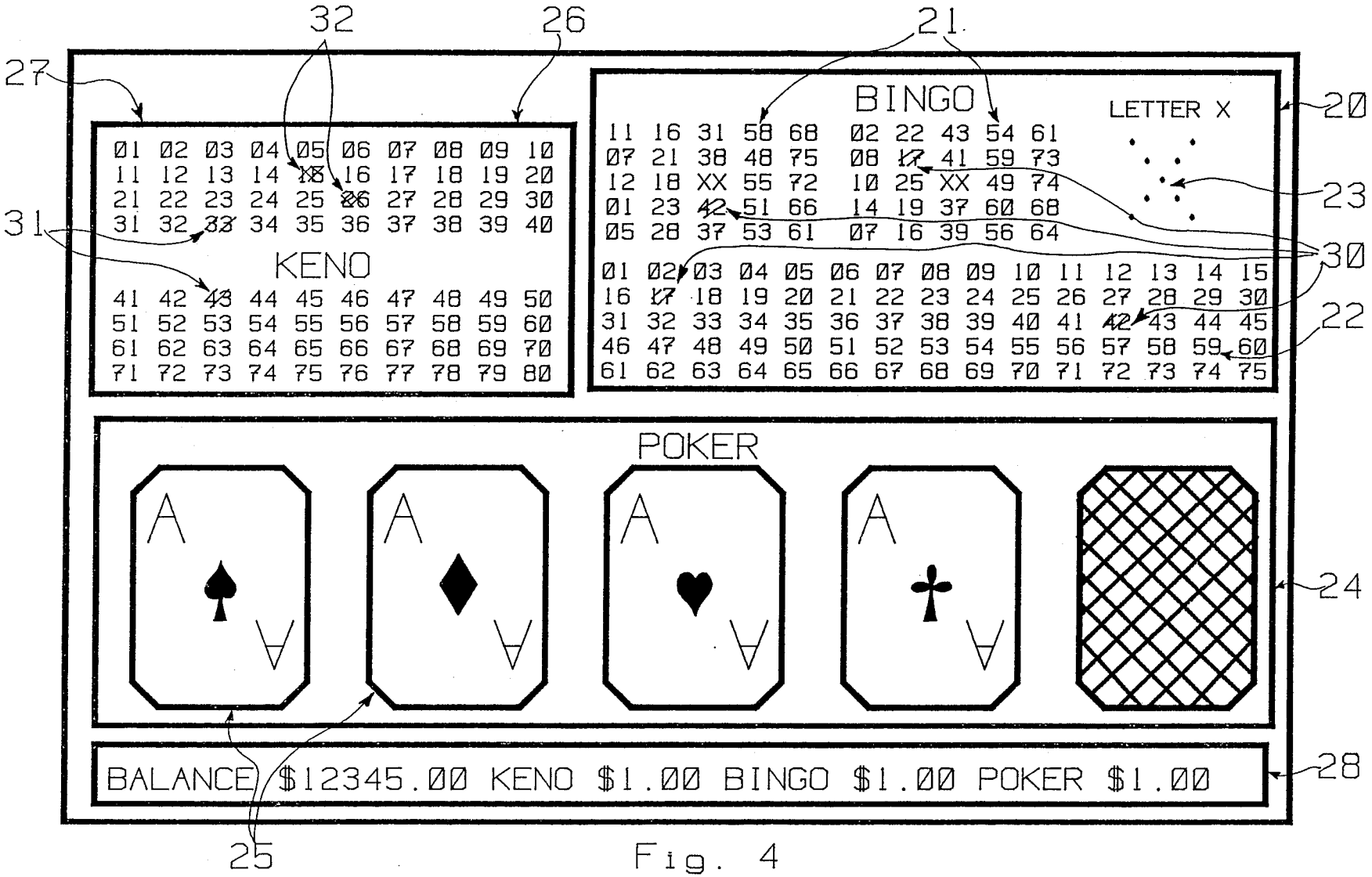
FIG. 4 shows the slave game device display screen with windows exhibiting status of the games being played.

Being a general purpose computer, the master game device is running under a multitasking operating system enabling a concurrent service of all the slave game devices 7. As illustrated in FIG. 3, the microprocessor 10 is also running under the multitasking operating system 14. The operating system 14 governs concurrently a number of tasks 15. Each task 15 executes an individual game. For example, one of the tasks 15, namely the task 16, may be a bingo game, whereas another, namely the task 17, may be a poker game, and the third, namely the task 18, may be a keno game, whereas the fourth task, namely the task 19, may be a blackjack game. Each of the tasks 15 has a display window associated with the task as illustrated in FIG. 4, wherein the window 20 displays two bingo cards 21, the bingo tableau 22 and the bingo pattern 23; the window 24 displays five poker cards 25, and the window 26 displays the keno card 27. In addition, the display also exibits the status window 28 showing accounting information. The status window 28 is governed by the dedicated task 29 under the auspices of the operating system 14.

Since the techniques of computer realization of individual card and chance games such as poker, keno, and bingo are well known and described in multiple U.S. patents, we ommit the detail description of software and hardware realization of the individual games as applicable to the slave game device 7. Also, in view of the wide availability of plentiful information on multitasking operating systems and display windowing techniques, we omit the details of implementation of the operating system 14, the concurrent tasks 15, and the windows 20, 24, 26, and 28.

Instead, the following description concentrates on nontrivial aspects of the design and operation of the suggested game network.

Due to the nature of the poker game, the task 17 runs independently of the operations of the master game device 1. Unlike the poker game, the bingo and the keno games are responsive to the master game device's commands and data being transmitted to all the slave game devices 7 via the communication network 6. In particular, the master game device 1 transmits to the slave game devices 7 the bingo pattern 23 and the called bingo numbers 30 (the numbers called by the game operator). The called bingo numbers 30 are marked in the cards 21 and the tableau 22 by crosshatching the matching number. Similarly, the master game device 1 transmits to the slave game devices the called keno numbers 31 (again, crosshatched in the window 26). The double crosshatched numbers 32 in the window 26 represent the player's selection of the keno number for the current round of the keno game.

The communication between the master game device 1 and the slave game devices 7 is bidirectional. The slave 7 receives commands and data from the master 1 and sends back the game status information and accounting data being generated by the task 29. In particular, if the slave game device 7 determines that a bingo or keno game reached the winning stage, the master 1 is immediately notified via the network 6; so that the respective game can be stopped by the game operator for verification of the winning. On the other hand, the master game device 1 may download a portion of the slave game device 7 software via the network 6 upon receiving a respective request from the latter.

While a specific embodiment of the invention has been shown and described in detail to illustrate the application of the invention principles, it is understood that the invention may be embodied otherwise without departing from such principles.

For example, the above description presumes that the game operator merely repeats and enters in the master game device 1 (echoes in) the bingo or keno numbers drawn in a conventional way. Yet, a conceivable variation of the technique is the utilization of a random number generator built-in the master game device.

Furthermore, the master and slave game devices do not have to be different hardwarewise or softwarewise. In fact, they may be identical (only a respective master task 32 should be added to the repertoire of the slave game device 7 tasks 15) and execute the master role in turns or even concurrently.

Figure 7:
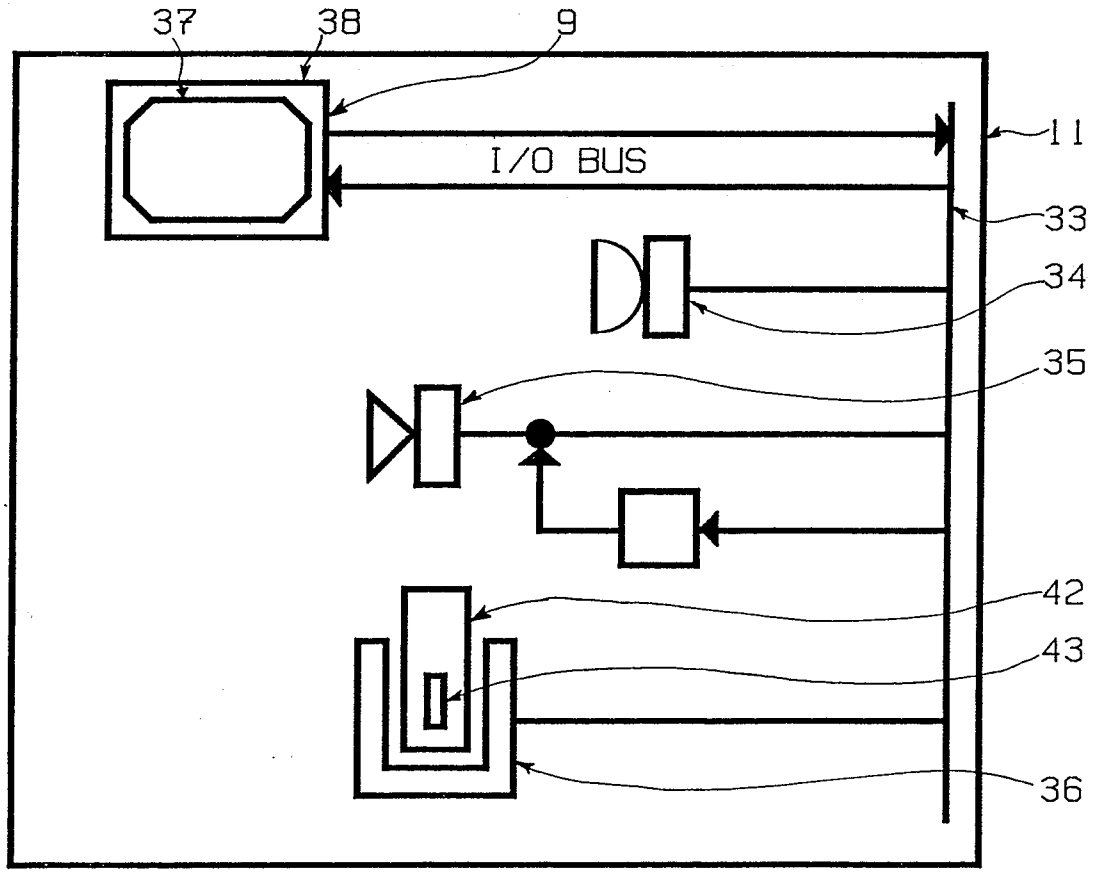
FIG. 7 shows the slave game device with an expanded input and output means.

Although the FIG. 2 shows only the simplest, minimal hardware configuration of the slave game device, the opportunities of playing a broad number of different games within the framework of the suggested game network can be greately enlarged by an expansion of the input and output (I/O) means 11 of the slave game device 7 as shown in FIG. 7.

This expanded I/O configuration attached to the I/O bus 33 of the microprpcessor 10 includes the touch screen display 9, the microphone 34, the speaker 35, and the electronic card reader and writer 36.

The touch screen display 9 comprising the CRT display 37 and the infrared grid bazel assembly 38 replaces the keypad 8 and simplifies and facilitates player's interaction with the slave game device 7. In particular, the touch screen is very convinient for making the menu selections as well as for the manual marking of the bingo and keno numbers.

Figure 5:
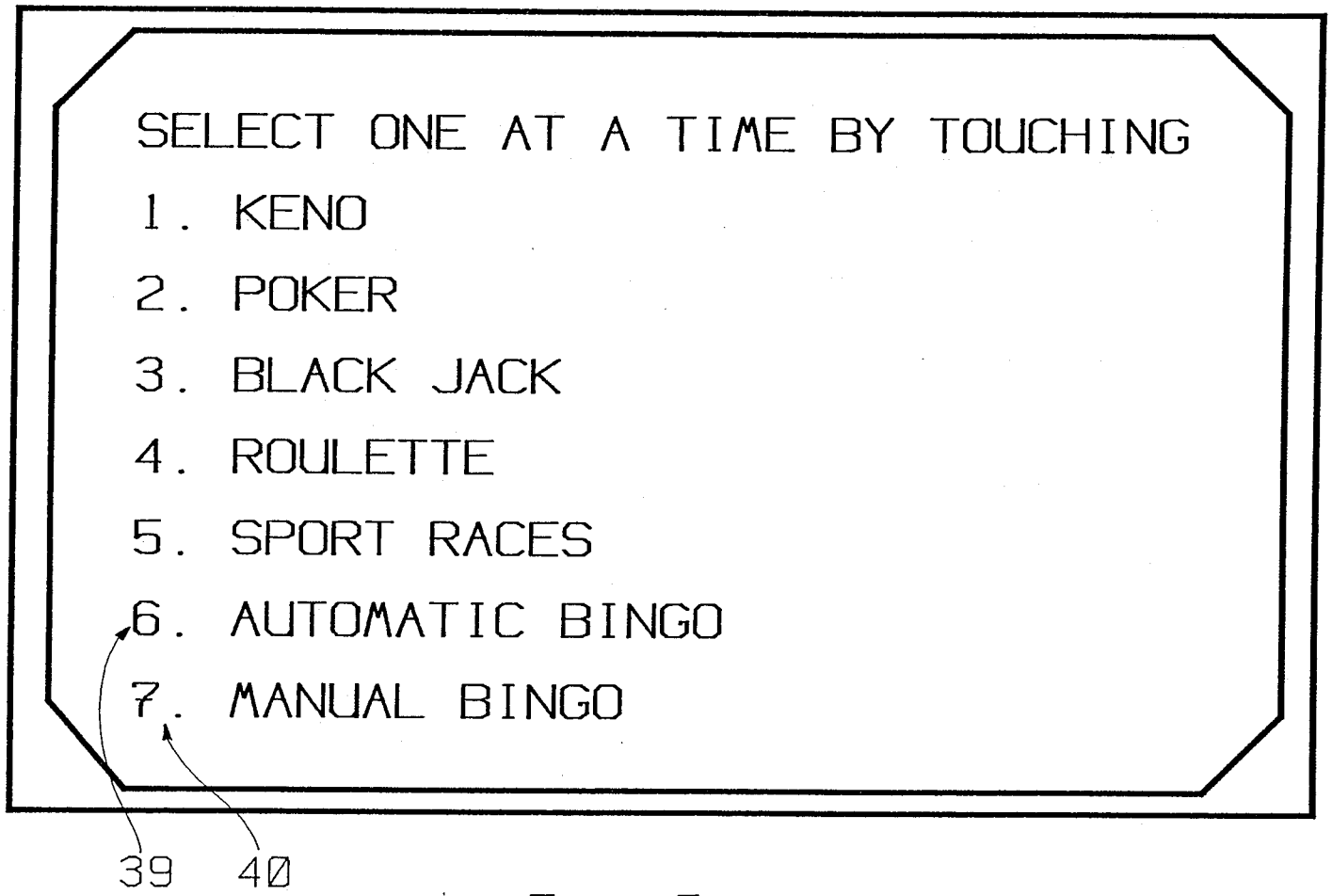
FIG. 5 shows a slave game device menu of game selections.
Figure 6:
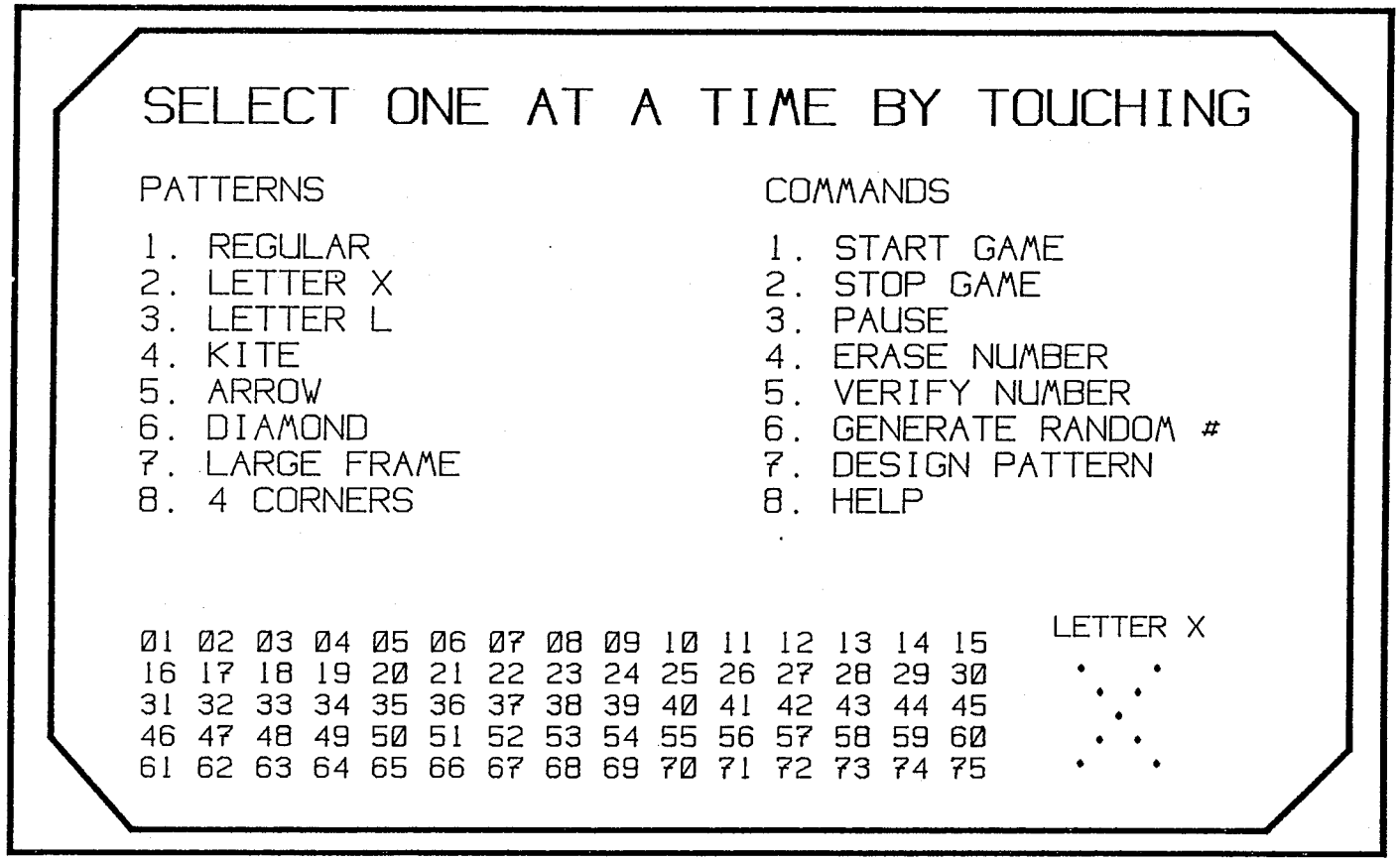
FIG. 6 shows a master game device menu of available commands for a bingo game.

As shown in FIG. 5, the slave game device provides two modes of playing the bingo game, namely the automatic mode 39 and the manual mode 40. In the automatic mode 39, the player only enters (via the touch screen display 9) the bingo card identification number (ID); the rest of the monitoring of the current status of the game is automatically done by the slave game device 7 as it is described in the U.S. Pat. No. 4,455,025. The manual mode 40 is a new mode of playing in which the player actively participates in the process of marking the matching bingo numbers 30 by touching respective numbers in the window 20. In response to the manual touch, the slave game device 7 crosshatches the selected number 30 (or shows it in reverse video, or changes the color, etc.)

Note, that the touch screen could be easily replaced with a light pen without a restriction of the scope of the invention. Note also, that the manual mode of playing a bingo game can be realized without the touch screen or a light pen just by utilization of the directional arrow buttons of the keypad 8 or even by a purely software technique, such as "the running cursor method", wherein the player marks the current location of the cursor by pushing the "Enter" pushbutton.

The microphone 34 allows for voice commands entry and the speaker 35 plays either the role of a tone annunciator in a simplified version of the device 7 or the role of a speech annunciator in a more elaborate version of the device 7 equipped with the voice synthesizer 41 built into the I/O structure 11.

The electronic card reader and writer 36 serves as the interface with the smart game card 42. In its preferred form, the smart game card 42 has an appearance of a traditional credit card but, unlike most of the credit cards presently in circulation, the game card 42 has a built-in microprocessor 43.

The microprocessor 43 keeps track of all the transactions made with the help of the card 42 including bets and outcomes of the games. Also, the microprocessor 43 stores game specific information, such as the bingo or keno game card contents, or the game card identification number (the technique of utilization of the game card identification number as an encoded key to the contents of a bingo game card is disclosed in the U.S. Pat. No. 4,455,025). The slave game device 7 interacts with (reads from and writes to) the microprocessor 43 via the card reader and writer 36. In particular, the game device 7 writes to the card 42 outcomes of the bets and reads from the microprocessor 43 the current account balance and the game card identification number. Note, that in certain specific applications, the suggested smart card reader and writer may be replaced with a conventional coin collector without departing from the principles of the invention.

It should be clearly understood without a restriction of the scope of this invention that games other than bingo, poker, blackjack, and keno as mentioned above can be played with the help of the suggested game network. Moreover, the slave game device 7 could play simultaneously a number of games of the same type. For example, a player could be playing two or more bingo games at once, specifically one local bingo game restricted to a specific location (e.g. a single casino) and a regional bingo game (e.g. a game encompassing several casinos).

In addition, the game network presents an opportunity for players to pool their resources and share the benefits of the success. Specifically, two or more players could combine their individual slave game devices 7 into a temporary allience utilizing predetemined commands entered via respective keypads 8. For example, two players may command their slave game devices 7 to bet equal amounts on a bingo game and split the game prize if any of their slave game devices wins. A war-type game where several pools of slave game devices 7 fight each other are also easily implementable within the framework of the invention. A conceivable variation of the resource pooling approach is the concept of clustering slave game devices 7 playing the same card game against the card dealer (the casino). For example, several players may play a common blackjack or poker game using their slave game devices 7.

It should be understood without a restriction of the scope of the invention that a broad variety of the communication media, communication protocols, and communication network architectures can be utilized in the suggested game network. In particular, coaxial cables, fiber optics, common carrier channels, and radio channels are suitable media, and various various packet switching protocols, such as Carrier Sence Multiple Access and token passing, are applicable. Also, a broad spectrum of the data packet encription techniques and hardware security measures are applicable to the network 6 along with the special security protection means associated with the smart game card 42 and the game card reader and writer 36.

It will be obvious to those skilled in the art that various changes may be made without departing from the scope of the invention and the invention is not to be considered limited to what is shown in the drawings and described in the specification.

What is claimed is:

1. Game network comprising at least one master game device interconnected with at least one slave game device; said slave game device executing concurrently at least two different distinct and independent games; each of said different distinct and independent games comprising its own unique rules of play and unique random factors; said different distinct and independent games including bingo, keno, poker, blackjack, roulette, slots, gin, and sports book; said master game device providing data for playing said games; and at least one of said two different distinct and independent games being at least partially responsive to said data from said master game device.

2. The combination of claim 1, wherein said slave game device incorporates a local data input and output means comprising a display means displaying simultaneously the current status of each of said two distinct and different independent games, a sound and voice data entry means, a sound and speech generating means, a touch responsive data entry means, a game card reading and writing means.

3. In combination, a smart game card and the combination of claim 2, wherein said smart game card incorporates an imbedded data storage and data processing means being accessible by and responsive to said game card reading and writing means.

4. The combination of claim 1, wherein said slave game device incorporates a software and hardware means for controlling the degree of difficulty of playing at least one of said two different distinct and independent games.

5. The combination of claim 1, wherein said slave game device displays matches between data being transmitted by said master game device and the contents of at least one game card for playing at least one of said two different distinct and independent games.

6. The combination of claim 1, wherein said slave game device transmits to said master game device accounting data and the current status of at least one of said two different distinct and independent games.

7. The combination of claim 1, wherein two or more of said slave game devices participate in a common game.

* * * * *

US004856787B1

REEXAMINATION CERTIFICATE (3334th)

United States Patent [19]

Itkis

[11] B1 4,856,787

[45] Certificate Issued Sep. 23, 1997

[54] CONCURRENT GAME NETWORK

[75] Inventor: Boris Itkis, Arcadia, Calif.

[73] Assignee: Fortunet Inc., Las Vegas, Nev.

Reexamination Request:
No. 90/004,128, Feb. 5, 1996

Reexamination Certificate for:

| | |
|---|---|
| Patent No.: | **4,856,787** |
| Issued: | **Aug. 15, 1989** |
| Appl. No.: | **198,599** |
| Filed: | **May 3, 1988** |

Related U.S. Application Data

[63] Continuation of Ser. No. 826,269, Feb. 5, 1986, abandoned.

[51] Int. Cl.[6] ..... A63F 3/06

[52] U.S. Cl. ..... 273/239; 273/269

[58] Field of Search ..... 273/237, 269, 273/138.1; 364/410, 411, 412

[56] References Cited

U.S. PATENT DOCUMENTS

| | | | |
|---|---|---|---|
| 4,305,131 | 12/1981 | Best | 364/521 |
| 4,339,798 | 7/1982 | Hedges et al. | 364/412 |
| 4,624,462 | 11/1986 | Itkis | 273/237 |

OTHER PUBLICATIONS

DATAMATION, Jun. 1983, vol. 29, No. 6, "Growing Panes Out West," pp. 241–242, by John W. Verity.

COMPUTERWORLD Office Automation, Oct. 12, 1983, vol. 17, No. 41A, "Integrated Software: More Than Meets The Eye," by Kathryn Cogswell Carr.

DATA COMMUNICATIONS, Jun. 1982, "Inside the smart card," pp. 36–37, by Edwin E. Mier.

*Primary Examiner*—William H. Grieb

[57] ABSTRACT

A distributed game network comprising a master game device and a number of slave game devices. The slave game device is capable of playing concurrently a number of menu selectable card and chance games, such as poker, bingo, blackjack, and keno. The slave game device receives commands and random data, such as bingo patterns and called bingo and keno numbers, from the master game device and sends the local game status and accounting information to the master game device. The slave game device is equipped with a touch screen display and a smart game card interface. The smart game card associated with the slave game device has an imbedded microprocessor keeping track of wagers and outcomes of the game. The touch screen display exhibits the status of the games being played in display windows and accepts player's commands including menu selections and bingo and keno card marks.

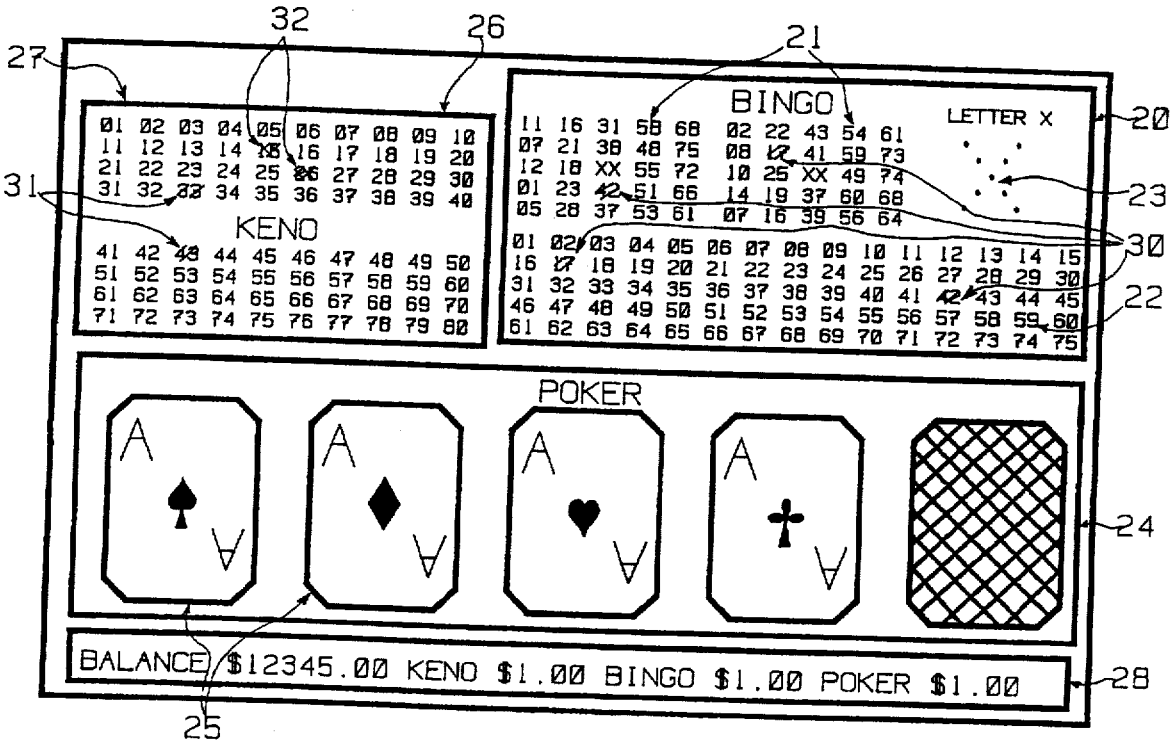

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *